United States Patent [19]

Wright et al.

[11] 4,221,298

[45] Sep. 9, 1980

[54] SECURITY-TYPE GARMENT HANGER

[76] Inventors: Kenneth Wright, 20800 Homestead Rd., Cupertino, Calif. 95014; Dennis J. Kenny, 1751 Terrace Dr., Belmont, Calif. 94002

[21] Appl. No.: 852,994

[22] Filed: Nov. 18, 1977

[51] Int. Cl.[2] ..... A47F 7/19

[52] U.S. Cl. ..... 211/4; 223/85

[58] Field of Search ..... 211/4, 7, 113, 118; 70/58, 59; 223/92, 91, 85, 88

[56] References Cited

U.S. PATENT DOCUMENTS

| | | | |
|---|---|---|---|
| 1,713,621 | 5/1921 | Price | 223/92 |
| 2,024,442 | 12/1935 | Flocco | 223/85 |
| 2,498,866 | 2/1950 | Suhajda | 223/85 |
| 3,014,593 | 12/1961 | Risely et al. | 211/4 |
| 3,378,144 | 4/1968 | Webster | 211/4 |
| 3,762,614 | 10/1973 | Musante | 223/98 |
| 3,792,776 | 2/1974 | Kenison | 211/118 |

FOREIGN PATENT DOCUMENTS

| | | | |
|---|---|---|---|
| 812821 | 9/1951 | Fed. Rep. of Germany | 223/92 |
| 1167190 | 11/1958 | France | 223/92 |
| 1537858 | 7/1968 | France | 223/98 |
| 376793 | 5/1964 | Switzerland | 223/92 |
| 5529 | of 1894 | United Kingdom | 223/85 |

*Primary Examiner*—Roy D. Frazier
*Assistant Examiner*—Robert W. Gibson, Jr.
*Attorney, Agent, or Firm*—John L. McGannon

[57] ABSTRACT

A security-type garment hanger capable of being attached against removal to a rack or similar support and capable of preventing a garment from being removed from the hanger. The coat hanger includes a metal bar which fits on the underside of one of a pair of inclined shoulder supporting members which are joined at their upper ends. The bar has an upper part which projects upwardly from the junction of the shoulder supporting members, the upper part providing a threaded stud capable of being attached to any one of a number of various types of racks. The other end of the metal bar has fastened to it a length of chain or other type of flexible member. In one embodiment, the free end of the chain is passed through the sleeve of a garment and looped up from the bottom of the garment through its interior and padlocked to the chain near the point where the chain is fastened to the metal bar. In another embodiment, a pair of rigid disks larger in diameter than the maximum transverse dimension of a buttonhole of the garment are padlocked to the length of chain after the disks are placed on opposite sides of the buttonhole so as to capture the fabric between them in a sandwich-like fashion.

2 Claims, 7 Drawing Figures

FIG. 1
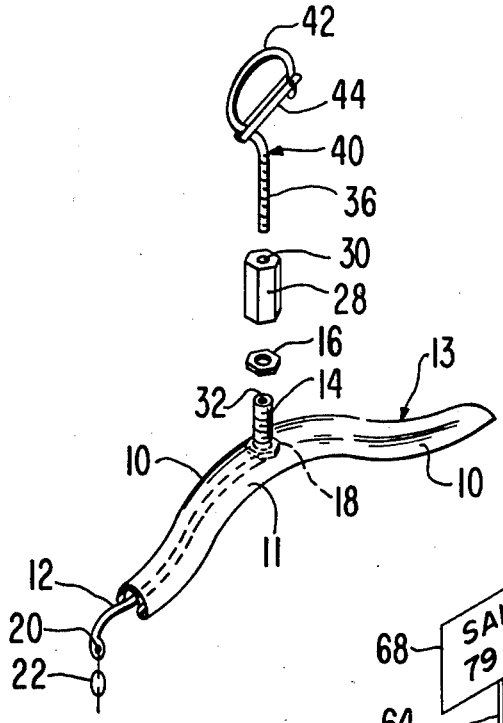
FIG. 3
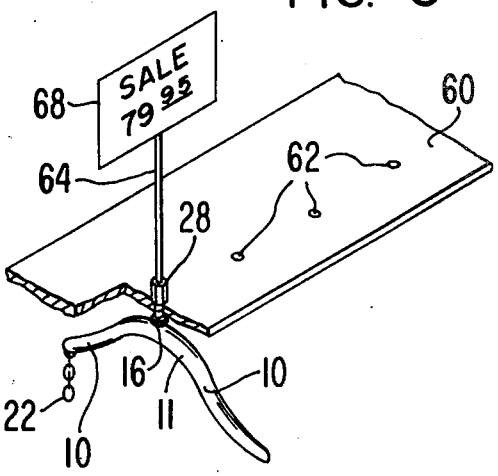
FIG. 2
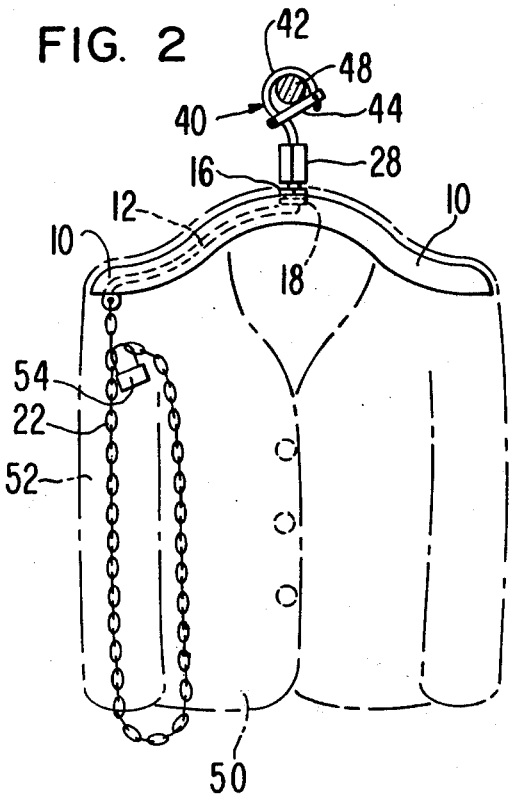
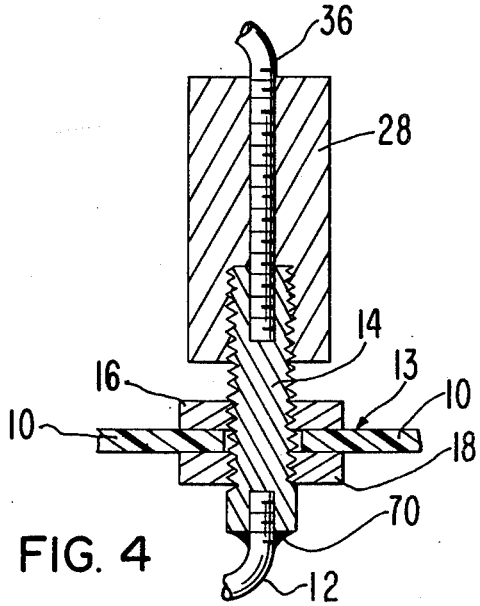
FIG. 4

SECURITY-TYPE GARMENT HANGER

BACKGROUND AND OBJECTS OF THE INVENTION

This invention relates to a garment security device generally, and more specifically to a hanger capable of having a garment locked thereto.

Security is often needed to protect garments hanging on a rack, such as in a retail clothing store or a public cloakroom, whenever the rack is left unattended. The present invention is suitable for use in either environment, but it is especially suitable for use in a retail clothing store.

Specialized cloakroom garment hangers, such as those disclosed in U.S. Pat. No. 2,868,605, U.S. Pat. No. 3,606,948 and U.S. Pat. No. 3,647,072, typically use a chain in conjunction with a locker or a lock box, which is often coin operated. These are not well-suited to retail merchandise displays for several reasons.

First, the cost of these relatively elaborate devices is relatively high. It is important to recognize that a suitable security-type garment hanger need not be made so sturdy or foolproof that its implementation costs more than the evil practices it seeks to reduce. A security-type coat hanger is generally used to thwart the activities of two types of thieves—the shoplifter who wishes to remain inconspicuous, and the snatcher who relies on being able to accomplish the theft in a very short time. Therefore, the device need only provide security that cannot be breached except by conspicuous or time-consuming activity on the part of a would-be thief.

Accordingly, it is an object of the present invention to provide a security-type coat hanger that is relatively inexpensive and yet provides reasonable security against theft.

A second problem arising in connection with the use of prior art devices of this type is the obtrusive nature of the devices. One feature that is especially desirable for a security-type garment hanger of a retail clothing store is that it appear to the casual observer to be a standard garment hanger and not, in fact, a security-type garment hanger. It has been found that a customer is deterred from trying on garments that the customer can clearly see is locked to the hanger.

This need for unobtrusiveness also serves a security purpose, since the would-be thief is forced to spend time that he cannot afford so as to determine which garments are locked and which are not. In the area of merchandise displays, hanger devices such as those disclosed in U.S. Pat. No. 3,885,674 and U.S. Pat. No. 3,985,183 use a flexible cable or chain which is attached at one end to a fixed rack, passes through the sleeve of a garment, and terminates in a ring or winged device larger than the maximum transverse dimension of the sleeve. While relatively less expensive, the security nature of these devices is still rather conspicuous.

It is an object of the present invention to provide a security-type coat hanger that is inconspicuous when in use.

A third problem inherent in prior art devices of this type is the fact that these devices are generally incompatible with existing racks. Thus, it is difficult for a retail garment store to change from one type of device to another inasmuch as additional expense is incurred as new racks must be acquired to accomodate the new devices.

Hence, it is another object of this invention to provide a security-type coat hanger that is compatible with existing racks of standard design.

A fourth problem of the prior art is the use of non-standard coat hangers, this problem is shared with devices such as those disclosed in U.S. Pat. No. 3,378,144 and U.S. Pat. No. 3,966,100 which use a flexible cable or chain secured at one end to the shoulder supporting element of a coat hanger and at the other end to a different part of the coat hanger. Standard coat hangers are cheaper and are more readily available. Indeed, a store owner contemplating a change to security hangers is likely to have his own source of supply.

Therefore, it is another object of the present invention to provide a security-type coat hanger that makes use of standard coat hanger parts.

SUMMARY OF THE INVENTION

The present invention comprises a coat hanger which is essentially standard in construction in that it has a pair of identical, slightly inclined shoulder supporting members of wood or molded plastic, the members being contoured to confront the inside of the shoulders of a garment without causing distortion that would otherwise occur if a regular wire hanger were used. A metal rod extending along one member has an upper part which projects upwardly from the junction of the supporting members. The upper part of the rod terminates in a special hook for attachment to a rack.

The metal bar preferably fits in a recess along the underside of one supporting member if such a recess exists. Some standard hangers have this recess formed in them during manufacture. The lower end of the metal bar has a length of flexible chain or other flexible element attached to it. The metal bar is held fast to the supporting member by any suitable means, such as by paired nuts, one above and one below the junction of the supporting members.

The part of the metal bar above the junction of the supporting members is adaptable to various types of display racks. Common to the different embodiments is a threaded cap which is securely threaded to the upwardly projecting stud of the metal bar so as to be removable only by use of a socket wrench, or other such tool. The upper portion of the overlying cap is threaded to receive a rod of a smaller diameter than that of the stud. The stud is internally threaded from its upper end so than a threaded shaft holding a small display sign can be threadably carried by the stud above or adjacent to the rack.

If a rack having a horizontal pole is used, an open loop hook is threaded into the top of the cap to the desired depth, even to the point of extending into the stud itself. The outer tip of the hook has a flattened region with a hole to which a clevis can be bolted so as to prevent the hanger from being removed from the pole rack.

An alternate type of rack includes a horizontal sheet metal plate-like member with a plurality of holes therethrough. The hanger of this invention is used in conjunction with such a rack by passing the stud upwardly through one such hole and threading the hexagonal cap onto the stud to prevent the hanger from falling to the floor. The top portion of the cap, can also be used to support a display sign.

The chain on the garment hanger of this invention may be secured to the garment in one of two ways. In a first embodiment, the chain is long enough so that its free end can be passed downwardly from the hanger through a sleeve to the bottom of the garment and then upwardly through the interior of the garment to be locked to the chain near the point at which it fastens to the metal bar.

A second embodiment, suitable for use with a garment having at least one buttonhole, makes use of a pair of rigid disks made from a suitable metal or plastic. One disk contains a U-shaped member adapted to fit through a central hole in the second disk. The U-shaped member is long enough so that when it passes through the hole of the second disk and the disks are maintained on opposite sides of a buttonhole at a separation corresponding to that of the fabric thickness, a sufficient portion of the U-shaped member protrudes from the second disk so that a padlock shackle may be passed through the member. In use, the U-shaped member is pushed through a buttonhole on the garment and then through the hole in the second disk with the first disk on the outside of the garment and the second disk on the inside. A padlock is used to keep the free end of the chain connected to the U-shaped member, and the U-shaped member is short enough so that when the padlock shackle is inserted, the disks hold the fabric snugly. This makes it difficult or impossible for a would-be thief to insert a blade to make the small cut from the buttonhole to the edge of the garment that would free the garment from the disks. The outside disk may be covered with a material which roughly matches that of the garment being protected.

Thus, it can be seen that the coat hanger disclosed herein provides adequate security while at the same time it remains unobtrusive. The different embodiments of the invention make it suitable for use with both pole-type and plate-type racks and with most types of garments.

BRIEF DESCRIPTION OF THE DRAWINGS

FIG. 1 is a partially cut-away, exploded view of the coat hanger of the present invention;

FIG. 2 shows the invention used in connection with a pole-type rack with the chain looped through the sleeve of the garment;

FIG. 3 is a partially cut-away view of the coat hanger used in connection with a plate-like rack and further illustrates the use of a stud and cap to provide a mounting for a display sign;

FIG. 4 is an enlarged cross section of the stud and fastening of the metal bar of the hanger to the contoured members of the hanger;

DESCRIPTION OF THE PREFERRED EMBODIMENT

Figure 5:
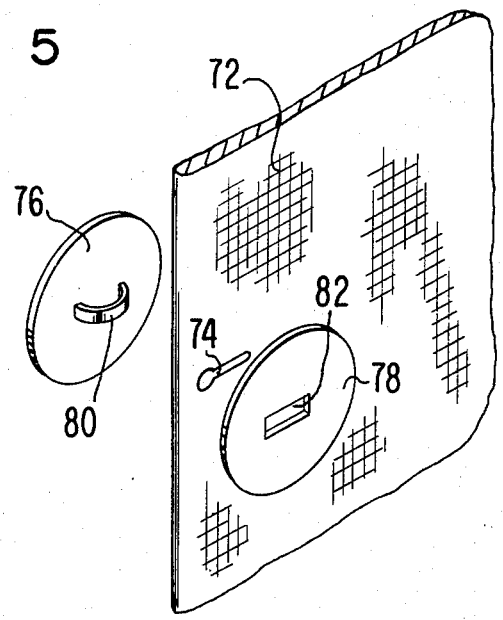
FIG. 5 shows another embodiment of the invention which uses a pair of disks adapted to be placed on opposite sides of a buttonhole of a garment.

A first embodiment of the garment hanger of this invention is shown in FIGS. 1–4 and includes a pair of generally inclined shoulder confronting or supporting members 10 typically made of plastic or wood and contoured to confront and support the inside of the shoulders of a garment without distorting them. Members 10 are typically of standard construction and are integral with each other or otherwise formed together at a junction 11 to form a hanger body 13. The underside of hanger body 13 is typically recessed to provide a lightweight construction for the hanger.

A metal bar 12 has a threaded stud 14 (FIGS. 1 and 4) at one end passing upwardly through a central hole at junction 11. A pair of hex nuts 16 and 18 hold stud 14 firmly attached to hanger body 13, and rod 12 fits snugly within the recess of the underside of hanger body 13 as shown in FIG. 1. The other end of bar 12 has a hole 20 (FIG. 1) through which an end link of a chain 22 is fastened.

A hexagonal cap 28 is internally threaded to fit on stud 14. As can be seen from FIG. 4, stud 14 does not extend all the way into cap 28. Stud 14 and cap 28 are drilled and tapped to a smaller diameter than that of stud 14, so as to receive a threaded rod which can extend downwardly through hole 30 in cap 28 and hole 32 in stud 14. In the embodiment of FIGS. 1 and 2, threaded end portion 36 of open loop hanger member 40 is the threaded rod. By threading both the stud and the cap, a greater variation in height of the hanger can be achieved.

Hanger member 40 has an upper curved portion 42 (FIG. 1) and a U-shaped clevis 44 attached at its free ends to the tip of portion 42 by a fixed pin through a transverse hole in the tip. Clevis 44 is long enough to form a closed loop. FIG. 2 shows how clevis 44 allows hanger member 40 to be attached against removal to a horizontal pole 48 by having curved portion 42 pass over pole 48, and clevis 44 pass under pole 48, the bight of the clevis being confined against movement by a lower, inclined portion or neck of hanger member 40.

FIG. 2 shows how the garment (in dashed lines) is secured to the hanger. Chain 22 extends downwardly through a sleeve 52 of garment 50 and passes beneath the lower margin 53 of the garment, then upwardly through the interior of the garment and back to the upper part of the chain. Padlock 54 is used to secure the free end of chain 22 to a link on chain 22 near the point at which the chain is secured to metal bar 12. In this manner, the garment is locked to the hanger and yet the chain is substantially unobtrusive.

FIG. 3 shows the invention used in connection with a plate-like rack. Horizontal sheet metal plate member 60 has a plurality of spaced holes 62 through any one of which stud 14 can pass. Cap 28, when threaded over stud 14 after the stud has been passed through one of the holes 62, is threaded onto the stud to connect the hanger to sheet metal member 60. Hole 30 in cap 28 is free to receive a rod 64 to which a display sign 68 is affixed.

In addition to this supporting function, and so long as the stud threads and the rod threads are of different pitch, cap 28 and stud 14 cooperate with threaded rod 64 or threaded portion 36 of hanger member 40 to provide a lock nut action when the threaded rod 36 or 64 is threaded the cap and into the stud. All that is needed to accomplish this is to give the cap a slight turn once everything is threaded together. Thus, a would-be thief finds it extremely difficult without the aid of wrenches or sockets to remove the hanger from the rack.

While metal bar 12 terminating in threaded stud 14 could be of unitary construction, weight and material cost considerations usually dictate that the major portion of bar 12 be of smaller diameter material than stud 14. FIG. 4 shows one method of accomplishing this. A straight portion of larger diameter rod is externally threaded to form stud 14. The bottom of stud 14 is threaded to the upper end of bar 12 and is additionally secured by a soft weld 70. FIG. 4 also shows how hex nuts 16 and 18 hold stud 14 in rigid relation to hanger body 13.

A second embodiment of the security hanger of this invention makes use of a buttonhole of the garment rather than a sleeve to secure the chain to the garment. FIG. 5 shows a section of garment 72 with buttonhole 74. Paired, rigid metal disks 76 and 78, preferably made of aluminum, are shown separated and about to be coupled to the garment. Each disk has a diameter which is greater than the maximum transverse dimension of the buttonhole; thus, the disks cannot pass through the buttonhole.

Figure 6:
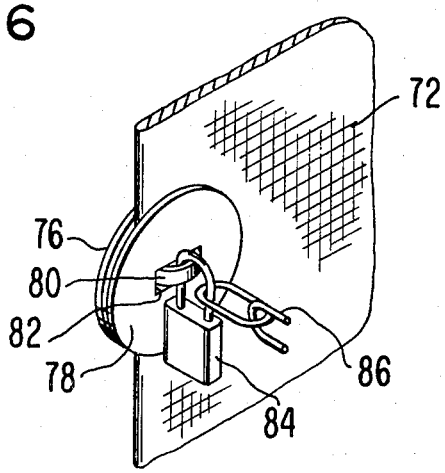
FIG. 6 shows the disks coupled together and locked to a garment.

Disk 76, the outside disk, has a U-shaped protruding member 80 adapted to fit through the buttonhole and through corresponding central hole 82 in disk 78. As can be seen from FIG. 6, when the disks engage the garment on opposite sides of the buttonhole so as to sandwich the garment between them, U-shaped member 80 extends through hole 82 and projects laterally from disk 78 so that padlock 84 can pass through the projecting, closed loop of member 80 in the manner shown in FIG. 6. This holds the disks together and secures them to the chain. The length of member 80 is chosen so that when padlock 84 is inserted, garment 72 is snugly captured between the disks. The snug fit prevents a would-be thief from inserting a knife blade between the disks to cut the garment, and the relatively large size, typically 2–3 inch diameter of the disks, makes it impractical to cut around the disks to remove the garment.

Figure 7:
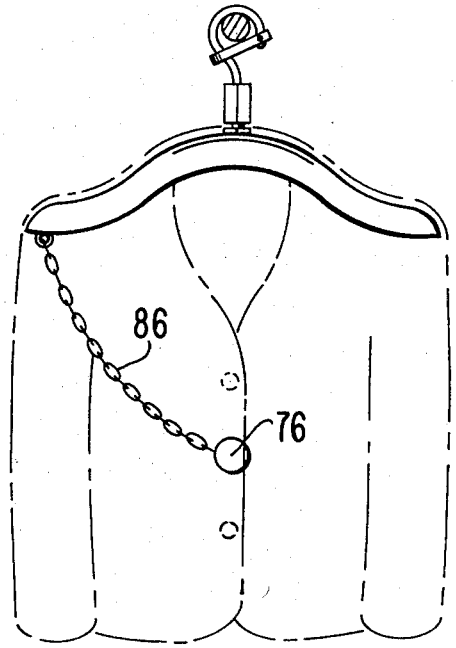
FIG. 7 shows the second embodiment of the coat hanger in connection with a pole-type rack and the chain to a buttonhole.

FIG. 7 shows the paired disk assembly used in connection with the security hanger. Although a horizontally extending rod, as shown in FIGS. 1 and 2, is employed, this aspect is not necessary for this embodiment since the chain no longer needs to pass downwardly through the sleeve of the garment. Thus, a metal bar or other such structure could extend downwardly from stud 14 a short distance and have chain 86 affixed to it. This would, in fact, add significant savings in the cost of the hanger, but would cause a slight decrease in unobtrusiveness since the portion of chain leading to the paired disks might be seen through the central, open part of the garment.

To further increase the unobtrusiveness of the paired disk embodiment, the outer surface of disk 76 can be covered with a fabric or material similar in appearance to that of the garment. In the alternative, disk 76 can be of a transparent plastic material so as to permit viewing the garment material through the disk. If the disk is of plastic, it will prevent damage of the garment due to discoloration. In any event, the merchant displaying the garment could have it arranged so that the edge having the buttonhole is under the edge having a button affixed to it, thereby hiding even the outer disk from view.

We claim:

1. A security-type garment hanger comprising: a hanger body having a pair of inclined, shoulder supporting members joined together at the central part of the body, there being a hole through the body at the junction of said members; a bar extending along one of the members and having an upper end provided with an externally threaded stud thereon, the stud extending through the hole and projecting upwardly therefrom, the bar having a lower end near the outer end of said one member; a pair of nuts coupled with the stud at locations above and below the hole for securing the stud and thereby the bar to the hanger body; means attached to said upper end of the stud for fixedly attaching the hanger body to a rack, said attaching means including a cap threadably mounted on the upper end of the stud and an open loop hanger member having a lower end portion threadably mounted on the upper end of the cap; a chain; means fixedly connecting one end of the chain to the lower end of the bar, said chain having a length sufficient to permit it to extend downwardly from the bar, through a sleeve of a garment supported by said members, beneath the lower margin of the garment, and upwardly through the interior of the garment and generally parallel to the sleeve to a location near said one end of the chain when the hanger body is attached to a rack; and a releasable lock for connecting the opposite end of the chain to the chain itself at said location.

2. The hanger of claim 1, wherein is included a horizontal pole defining a rack, said open loop hanger member including a rod having a curved portion adapted to fit over said pole, the tip of said rod having a hole therethrough, a U-shaped clevis having a pair of free ends and respective holes at its free ends, said clevis being long enough to reach across a part of said curved portion to form a closed loop, and a pin passing through said clevis holes and the hole in the tip to secure the clevis to said curved portion to form said closed loop.

* * * * *